US006837052B2

(12) United States Patent
Martling

(10) Patent No.: US 6,837,052 B2
(45) Date of Patent: Jan. 4, 2005

(54) ADVANCED FUEL NOZZLE DESIGN WITH IMPROVED PREMIXING

(75) Inventor: Vincent C. Martling, Jupiter, FL (US)

(73) Assignee: Power Systems Mfg, LLC, Jupiter, FL (US)

( * ) Notice: Subject to any disclaimer, the term of this patent is extended or adjusted under 35 U.S.C. 154(b) by 0 days.

(21) Appl. No.: 10/389,523

(22) Filed: Mar. 14, 2003

(65) Prior Publication Data

US 2004/0177615 A1 Sep. 16, 2004

(51) Int. Cl.[7] ..... F23R 3/20
(52) U.S. Cl. ..... 60/737; 60/746; 60/747
(58) Field of Search ..... 60/737, 748, 746, 60/747

(56) References Cited

U.S. PATENT DOCUMENTS

| | | | | |
|---|---|---|---|---|
| 4,292,801 A | | 10/1981 | Wilkes et al. | |
| 4,982,570 A | | 1/1991 | Waslo et al. | |
| 5,199,265 A | | 4/1993 | Borkowicz | |
| 5,319,923 A | * | 6/1994 | Leonard et al. | 60/737 |
| 5,408,830 A | * | 4/1995 | Lovett | 60/737 |
| 5,778,676 A | * | 7/1998 | Joshi et al. | 60/737 |
| 6,282,904 B1 | | 9/2001 | Kraft et al. | |
| 6,363,724 B1 | * | 4/2002 | Bechtel et al. | 60/737 |
| 6,438,961 B2 | * | 8/2002 | Tuthill et al. | 60/737 |
| 6,446,439 B1 | | 9/2002 | Kraft et al. | |
| 6,675,581 B1 | * | 1/2004 | Stuttaford et al. | 60/737 |
| 6,691,516 B2 | * | 2/2004 | Stuttaford et al. | 60/737 |
| 6,722,132 B2 | * | 4/2004 | Stuttaford et al. | 60/737 |

* cited by examiner

*Primary Examiner*—Ted Kim
(74) *Attorney, Agent, or Firm*—Brian R. Mack

(57) ABSTRACT

A fully premixed secondary fuel nozzle assembly for use in a gas turbine combustor having multiple combustion chambers, in which the products of the premixed secondary fuel nozzle assembly are injected into the second combustion chamber for supporting a pilot flame and flame transfer between combustion chambers, is disclosed. The improvement includes the elimination of the pilot fuel circuit, which previously served to establish flame in the second combustion chamber. The secondary fuel nozzle assembly includes at least one first injector extending radially outward from the fuel nozzle body for injecting all fuel from the fuel nozzle to mix with compressed air prior to combustion. The first injector can include a plurality of tubes or an annular manifold circumferentially disposed about the nozzle body. Compressed air is drawn into the nozzle body and passes through holes in an injector plate at the tip region to provide cooling.

20 Claims, 8 Drawing Sheets

ADVANCED FUEL NOZZLE DESIGN WITH IMPROVED PREMIXING

BACKGROUND OF THE INVENTION

1. Field of the Invention

This invention relates generally to a premix fuel nozzle for use in a dual stage dual mode gas turbine combustor and more specifically to a premix fuel nozzle that does not contain a fuel circuit dedicated to support a pilot flame nor a fuel circuit dedicated to transfer a flame between combustor zones.

2. Description of Related Art

The U.S. Government has enacted requirements for lowering pollution emissions from gas turbine combustion engines, especially nitrogen oxide (NOx) and carbon monoxide (CO). These emissions are of particular concern for land based gas turbine engines that are used to generate electricity since these types of engines usually operate continuously and therefore emit steady amounts of NOx and CO. A variety of measures have been taken to reduce NOx and CO emissions including the use of catalysts, burning cleaner fuels such as natural gas, and improving combustion system efficiency. One of the more significant enhancements to land based gas turbine combustion technology has been the use of multiple combustor stages to lower emissions. An example of this technology is shown in FIG. 1 and discussed further in U.S. Pat. No. 4,292,801. FIG. 1 shows a dual stage dual mode combustor typically used in a gas turbine engine for generating electricity. Combustor 12 has first stage combustion chamber 25 and a second stage combustion chamber 26 interconnected by a throat region 27, as well as a plurality of diffusion type fuel nozzles 29. Depending on the mode of operation, combustion may occur in first stage combustion chamber 25, second stage combustion chamber 26, or both chambers. When combustion occurs in second chamber 26, the fuel injected from nozzles 29 mixes with air in chamber 25 prior to ignition in second chamber 26. As shown in FIG. 1, an identical fuel nozzle 29 is positioned proximate throat region 27 to aid in supporting combustion within second chamber 26. While the overall premixing effect in first chamber 25 serves to reduce NOx and CO emissions from this type combustor, further enhancements have been made to the centermost fuel nozzle since fuel and air from this fuel nozzle undergo minimal mixing prior to combustion.

A combined diffusion and premix fuel nozzle 31, which is shown in FIG. 2, has been used instead of the diffusion type fuel nozzle 29 shown proximate throat region 27 in FIG. 1. When utilized in a dual stage combustor, fuel nozzle 31 supports both the establishment of a pilot flame in second combustion chamber 26 through dedicated fuel circuit 33 as well as to transfer the flame from first combustion chamber 25 to second combustion chamber 26 through increased fuel flow to premix injectors 32. Although some mixing improvement was attained through premix injectors 32, by creating a longer distance over which to mix fuel with surrounding air, nozzle 31 still contained a dedicated fuel circuit 33 that did not mix with air prior to exiting nozzle 31 and combusting. This dedicated fuel circuit 33, while providing a stable pilot flame source rich in fuel, does not provide adequate mixing prior to combustion, which is required to reduce emissions. Therefore, elevated levels of NOx and CO emissions continue to occur with this nozzle design.

What is needed is a fuel nozzle configuration that is completely premixed, can establish a flame in a second combustion chamber of a dual stage dual mode combustor without a dedicated pilot fuel source, and move a flame from the first combustion chamber to the second combustion chamber utilizing existing fuel premix circuits. A fuel nozzle having this structure will not only reduce overall operating emissions, but will have a simpler design and reduce overall manufacturing time.

SUMMARY AND OBJECTS OF THE INVENTION

An improved fully premixed secondary fuel nozzle assembly for use in a gas turbine combustor having multiple combustion chambers, in which the products of the premixed secondary fuel nozzle assembly are injected into the second combustion chamber for supporting a pilot flame and transferring the flame between combustion chambers, is disclosed. The improvement includes the elimination of the pilot fuel circuit, which previously served to directly establish a flame in the second combustion chamber. The improved premix secondary fuel nozzle includes at least one first injector extending radially outward from the fuel nozzle body for injecting all fuel from the fuel nozzle to mix with compressed air prior to combustion. That is, fuel that was previously directed to the pilot circuit, now passes through the first injector. In the preferred embodiment, the first injector comprises a plurality of radially extending tubes, while an alternate embodiment discloses the first injector as an annular manifold. In each embodiment, the first injector is in fluid communication with a first passage which receives fuel from base. A plurality of second passages extend from upstream of the first injector to downstream of the first passage and are in fluid communication with air surrounding the fuel nozzle assembly. Air from the second passage then passes through a third passage and to the nozzle tip region where it exits the nozzle through a plurality of holes in an injector plate to cool the nozzle tip. The fuel nozzle assembly is configured such that, in order to provide enhanced premixing while supporting flame transfer capability, all fuel is injected into a surrounding air stream, upstream of the nozzle third passage.

It is an object of the present invention to provide a fuel nozzle assembly having improved premixing and lower emissions while maintaining sufficient combustor stability.

It is a further object of the present invention to provide a fuel nozzle assembly having a simplified design and fewer components resulting in reduced manufacturing time.

In accordance with these and other objects, which will become apparent hereinafter, the instant invention will now be described with particular reference to the accompanying drawings.

DETAILED DESCRIPTION OF THE PREFERRED EMBODIMENT

Figure 1:
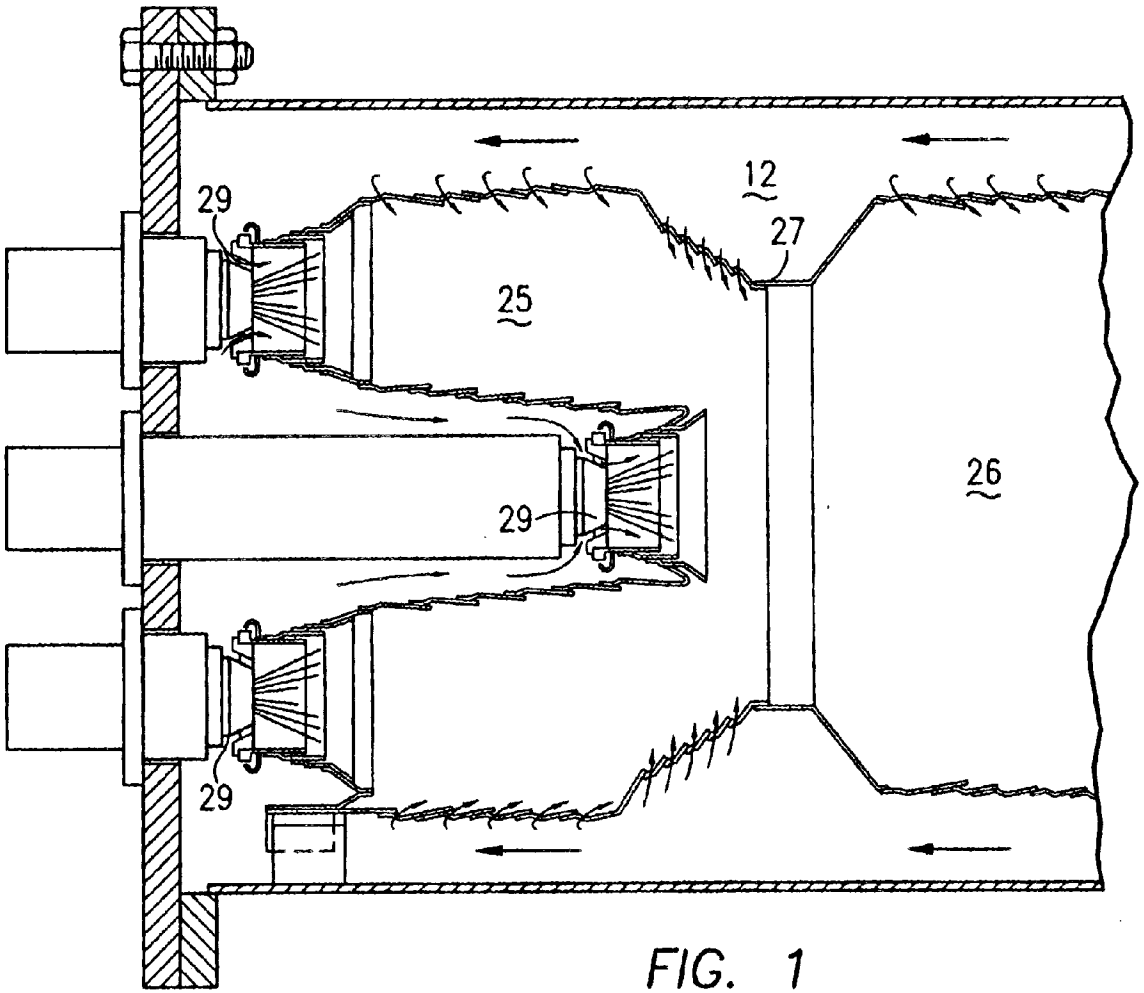
FIG. 1 PRIOR ART
FIG. 1 is a cross section view of a dual stage dual mode combustor of the prior art.
Figure 2:
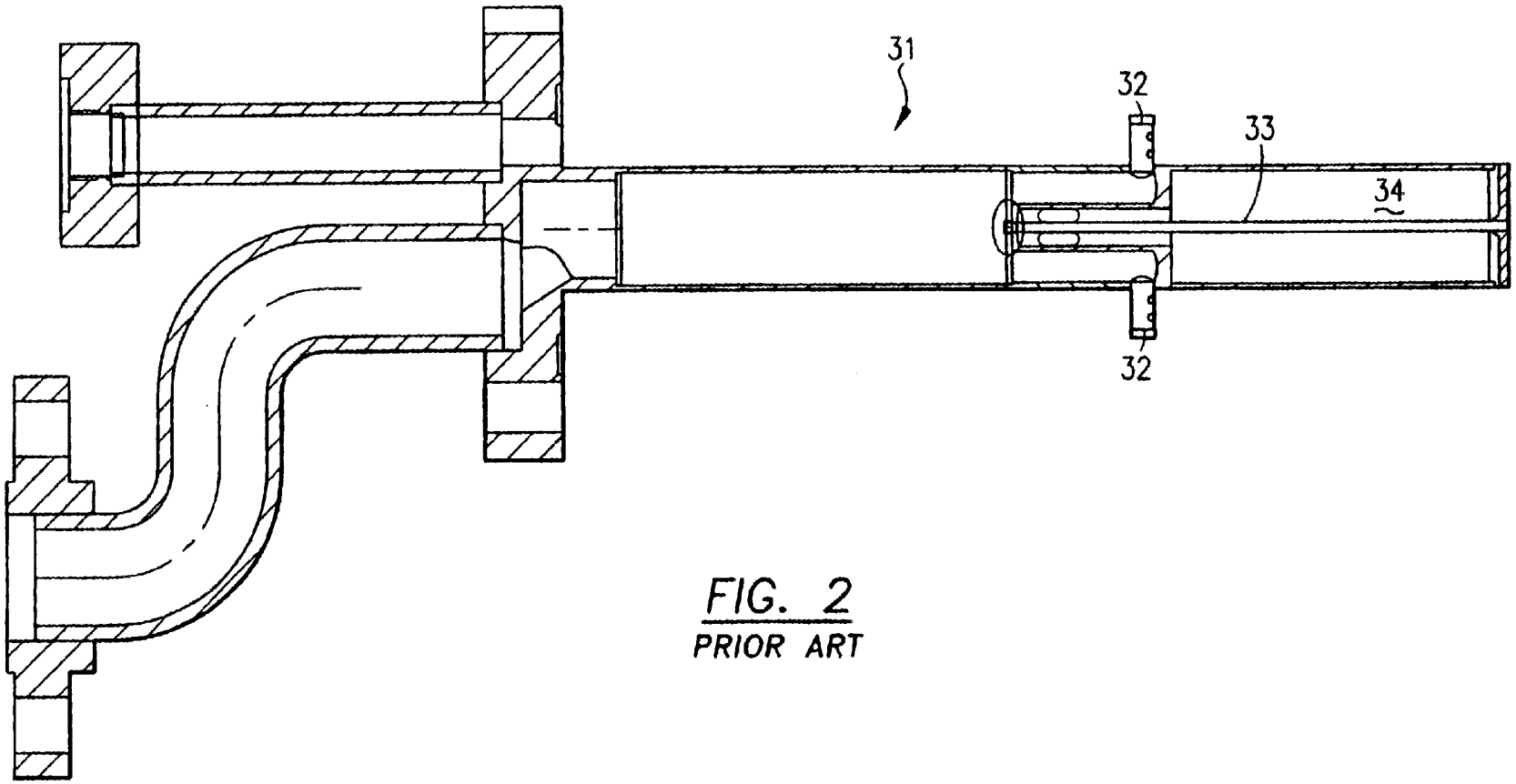
FIG. 2 PRIOR ART
FIG. 2 is a cross section view of a secondary fuel nozzle of the prior art having a dedicated pilot fuel circuit.
Figure 3:
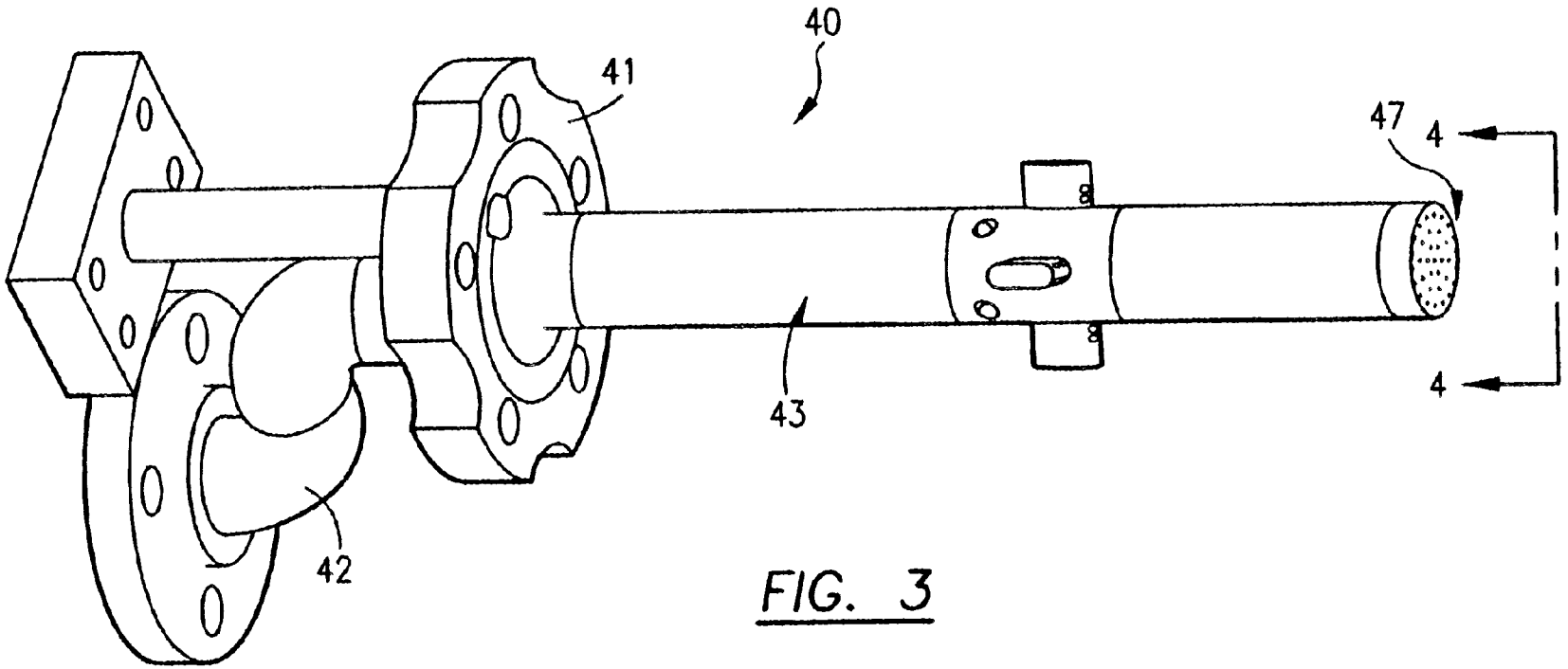
FIG. 3 is a perspective view of the present invention.
Figure 4:
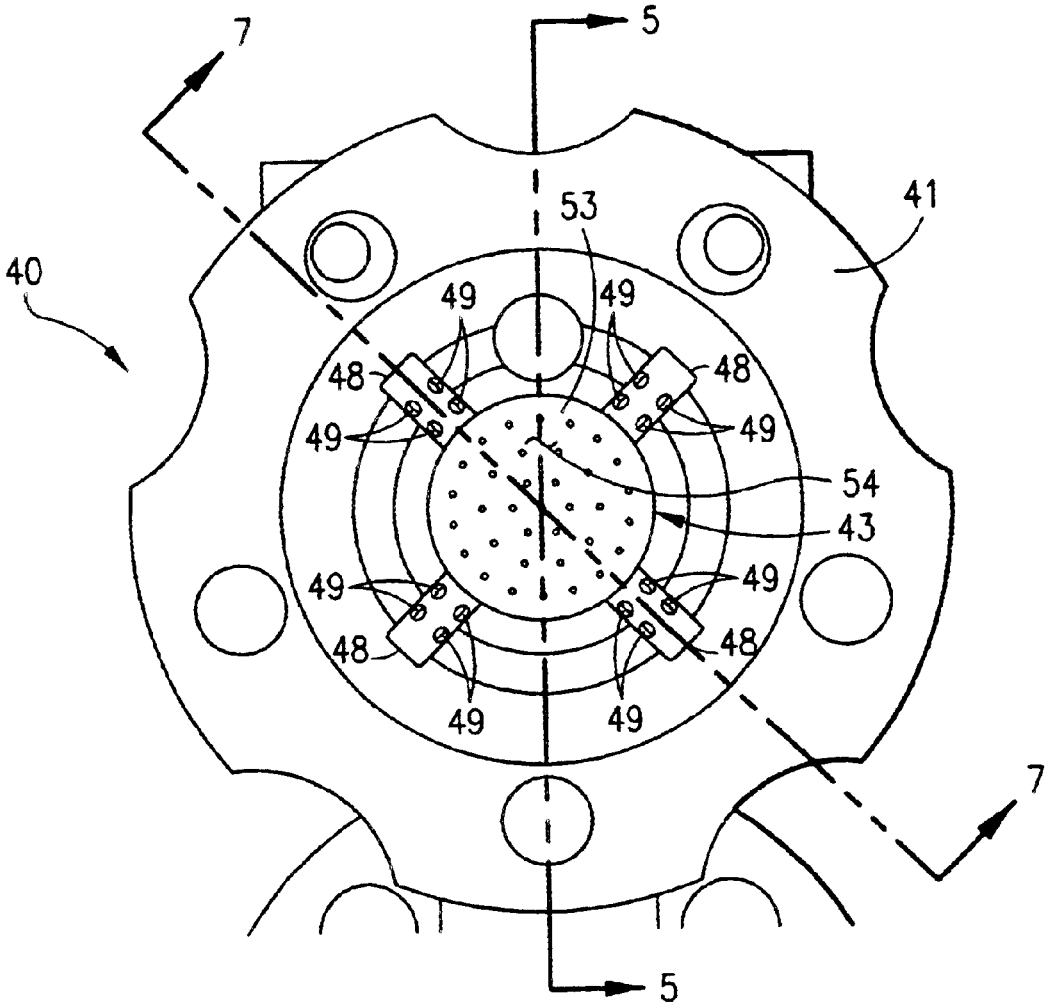
FIG. 4 is an end view of the present invention.
Figure 5:
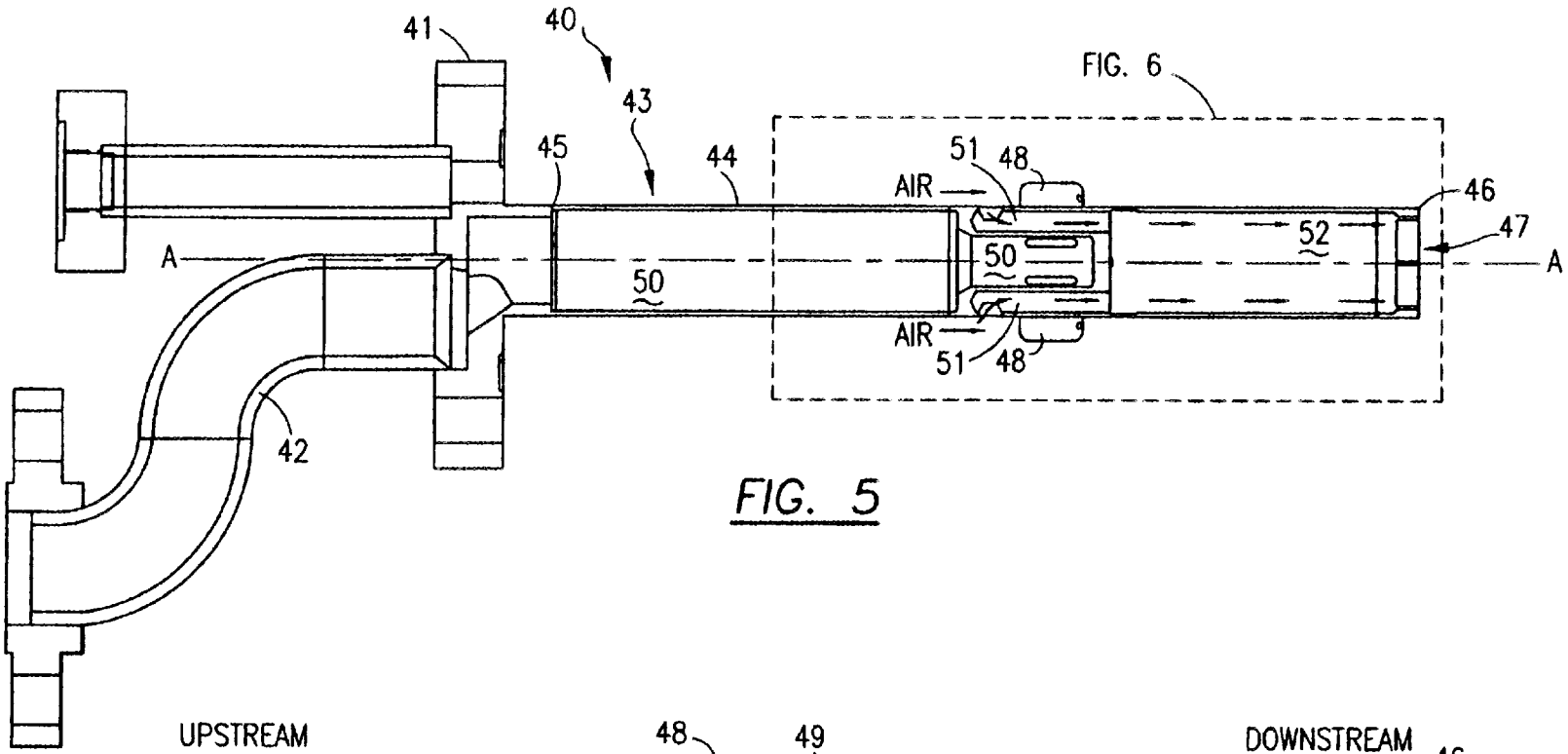
FIG. 5 is a cross section view of the preferred embodiment of the present invention.
Figure 6:
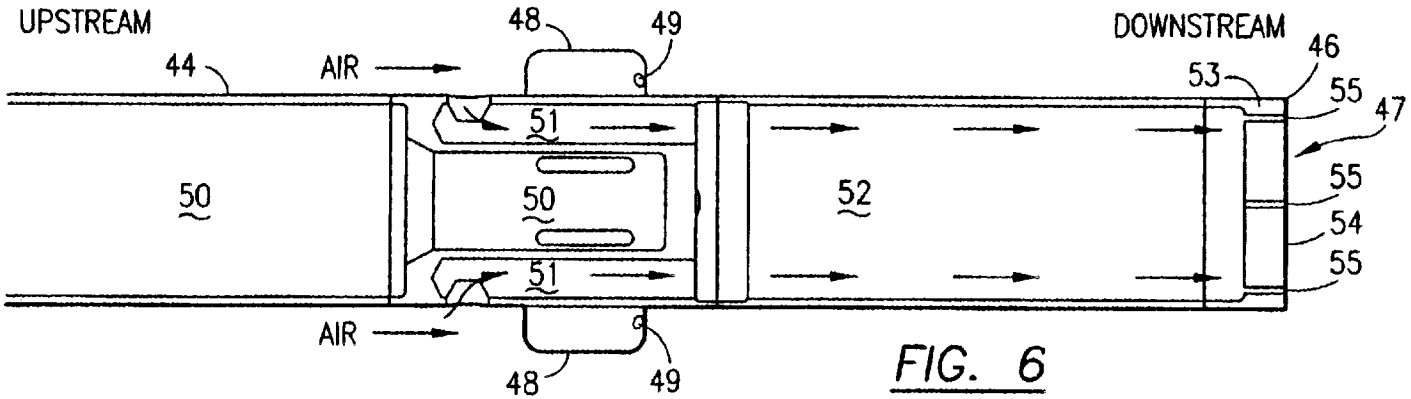
FIG. 6 is a detailed cross section view of the preferred embodiment of the present invention.

The present invention will now be described in detail and is shown in FIGS. 3–11. Referring to FIG. 3, a secondary fuel nozzle assembly 40 is shown in perspective view. Secondary fuel nozzle assembly 40, which is preferably used along a center axis of a dual stage dual mode combustor, similar to that shown in FIG. 1, contains a base 41, means for supplying fuel 42 to base 41, and a nozzle body 43. Referring now to FIGS. 3 through 8, nozzle body 43 comprises an elongated tube 44 having a first end 45, opposing second end 46, and a centerline A—A defined therethrough. First end 45 is fixed to base 41 such that elongated tube 44 is in fluid communication with base 41. Nozzle body 43 also includes a tip region 47 proximate second end 46.

Extending radially away from and fixed to elongated tube 44 is at least one first injector 48. As shown best in FIGS. 4 and 8, each first injector 48 contains at least one first injector hole 49 for injecting a fuel into a combustor. First injectors 48 extend radially into a region surrounding fuel nozzle 40 that contains compressed air such that fuel injected from first injector holes 49 mixes with the air to form a premixture. In the preferred embodiment, at least one first injector 48 has at least one radially extending projection with at least one first injector hole 49 oriented generally in a downstream direction. Typically, at least one first injector hole 49 has a first diameter of at least 0.070 inches.

Figure 7:
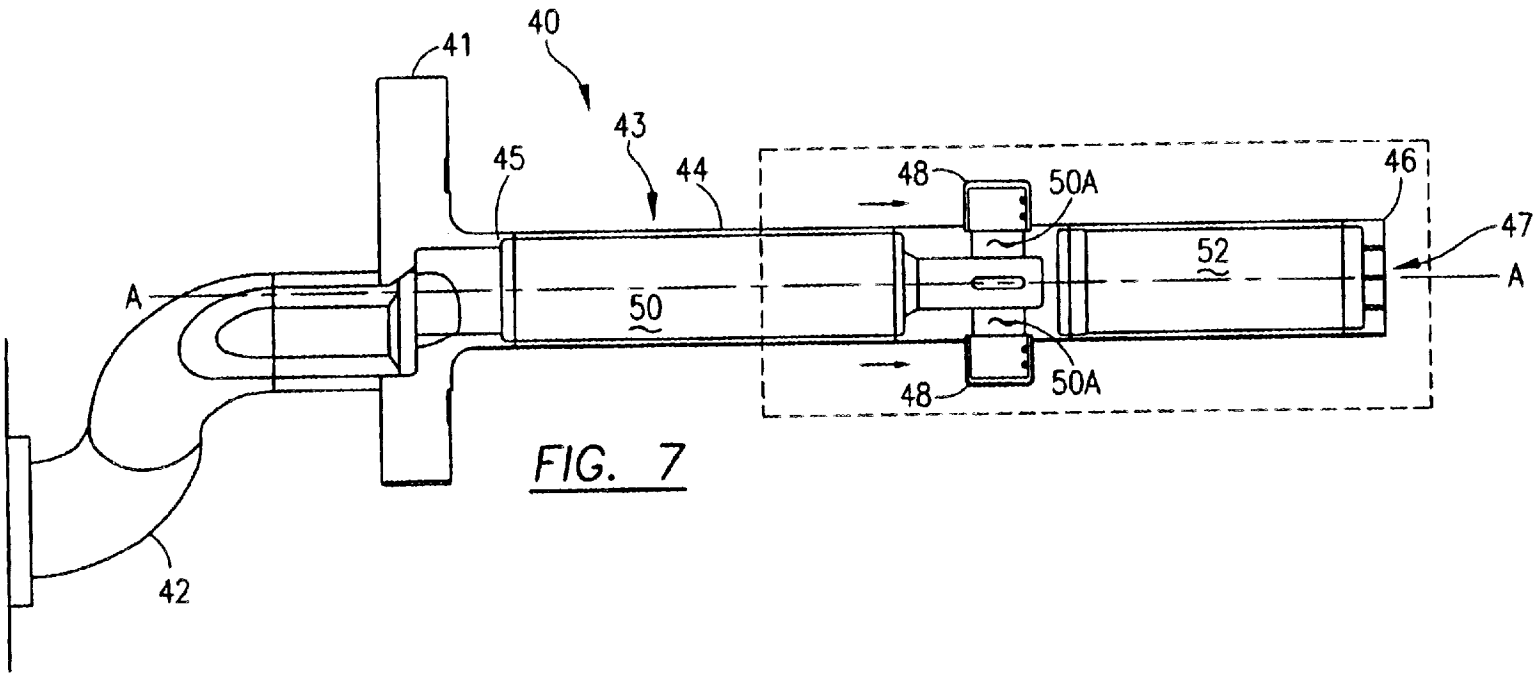
FIG. 7 is an alternate cross section view of the preferred embodiment of the present invention.
Figure 8:
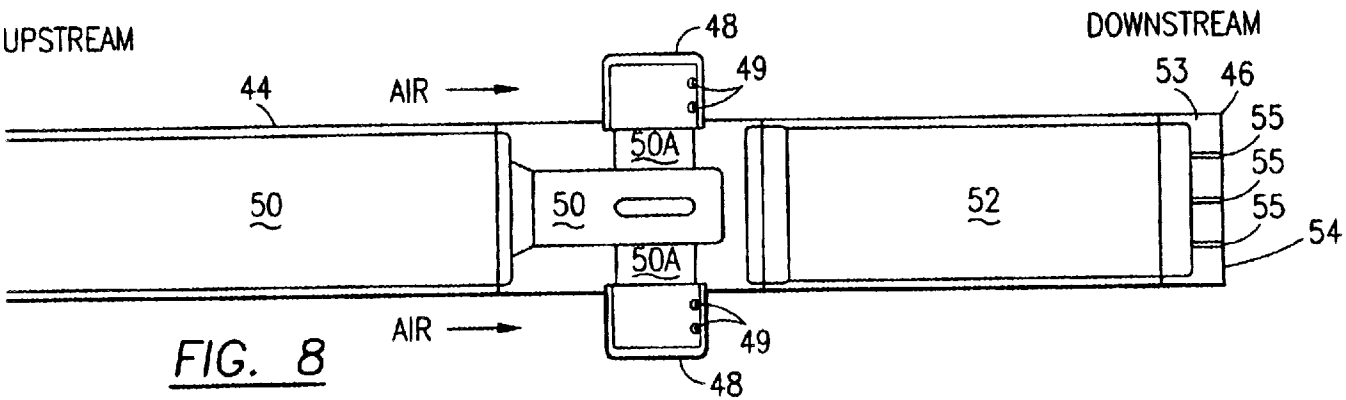
FIG. 8 is a detailed view of the alternate cross section of the preferred embodiment of the present invention.

Referring to FIGS. 7 and 8, a first passage 50 is located within elongated tube 44 and extends from first end 45 to proximate at least one first injector 48. First passage 50, which is in fluid communication with at least one first injector 48 through channels 50A, contains fuel that is supplied from base 41. Referring back to FIGS. 5 and 6, nozzle body 43 also includes a plurality of second passages 51 that extend from upstream of at least one first injector 48 to downstream of first passage 50. Second passages 51 are in fluid communication with compressed air surrounding fuel nozzle assembly 40. In the preferred embodiment, plurality of second passages 51 consists of four passages spaced radially within elongated tube 44. In fluid communication with plurality of second passages 51, is a third passage 52 that extends from downstream of first passage 50 to nozzle tip region 47. Located proximate nozzle tip region 47 is an injector plate 53 having an outer surface 54 and a plurality of second injector holes 55 that are in fluid communication with third passage 52 such that they are generally perpendicular to outer surface 54. Compressed air flow from external of nozzle body 43 flows through plurality of second passages 51, to third passage 52, and then through second injector holes 55 to cool nozzle tip region 47. In the preferred embodiment, second injector holes have a second diameter of at least 0.035 inches.

Figure 9:
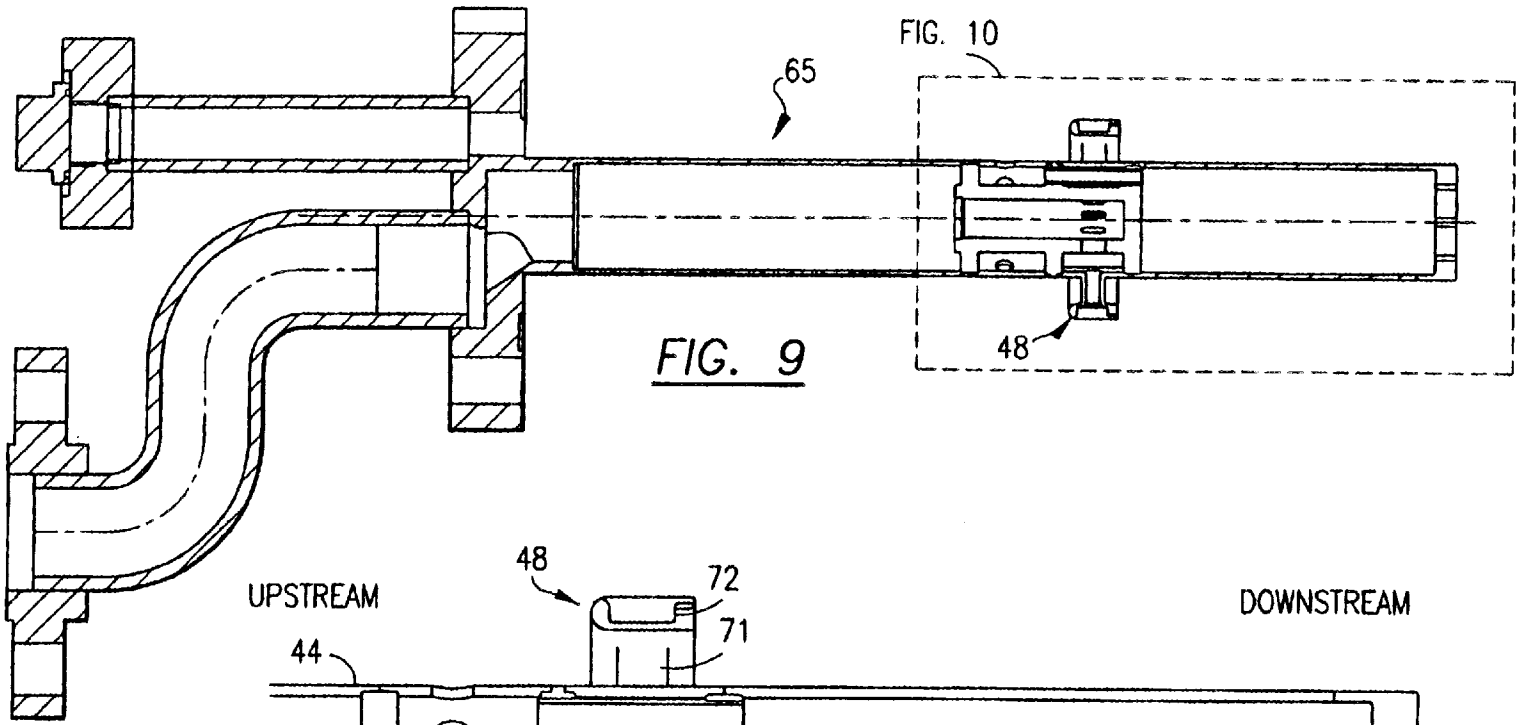
FIG. 9 is a cross section view of an alternate embodiment of the present invention.
Figure 10:
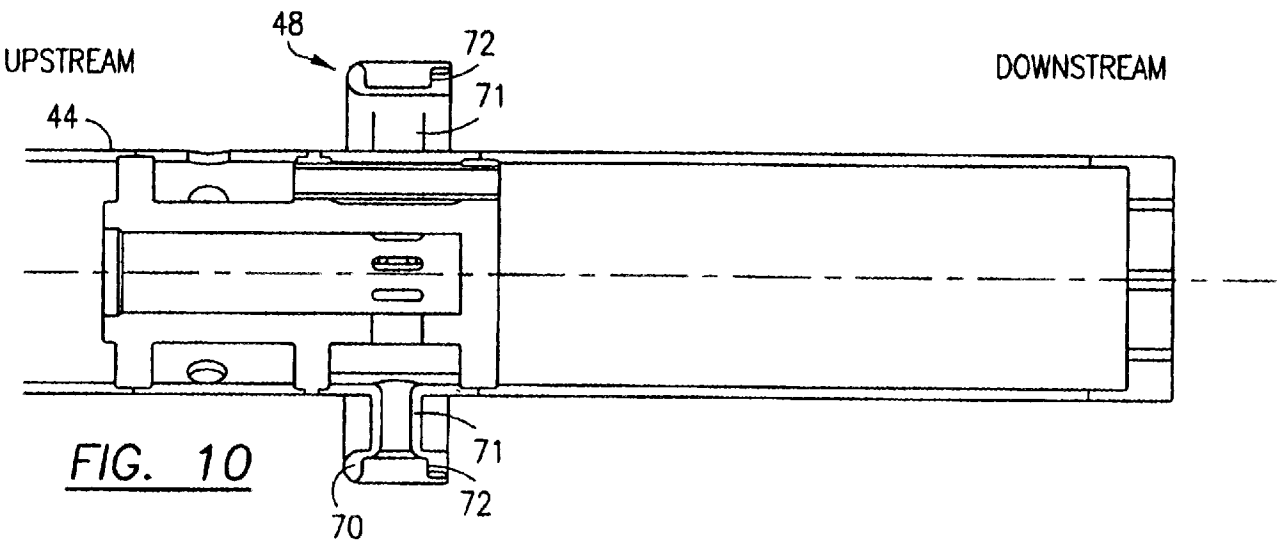
FIG. 10 is a detailed cross section view of an alternate embodiment of the present invention.

Referring now to FIGS. 9 and 10, an alternate embodiment of the present invention is shown in cross section. A majority of the details of alternate embodiment secondary fuel nozzle assembly 65 are identical to the preferred embodiment secondary fuel nozzle assembly 40 and therefore will not be discussed in further detail. In the alternate embodiment of the present invention first injector 48 comprises an annular manifold 70 circumferentially disposed about elongated tube 44 and affixed to a plurality of support members 71, which are in turn, affixed to elongated tube 44. Annular manifold 70 contains a plurality of first injector holes 72 situated about its periphery and oriented to inject fuel in a downstream direction with at least one first injector hole 72 being circumferentially offset from support members 71. It is preferred that each of the first injector holes 72 have a first diameter of at least 0.055 inches. The use of annular manifold 70 allows for improved circumferential fuel distribution by introducing fuel about the entire periphery of manifold 70 as opposed to discrete locations.

Figure 11:
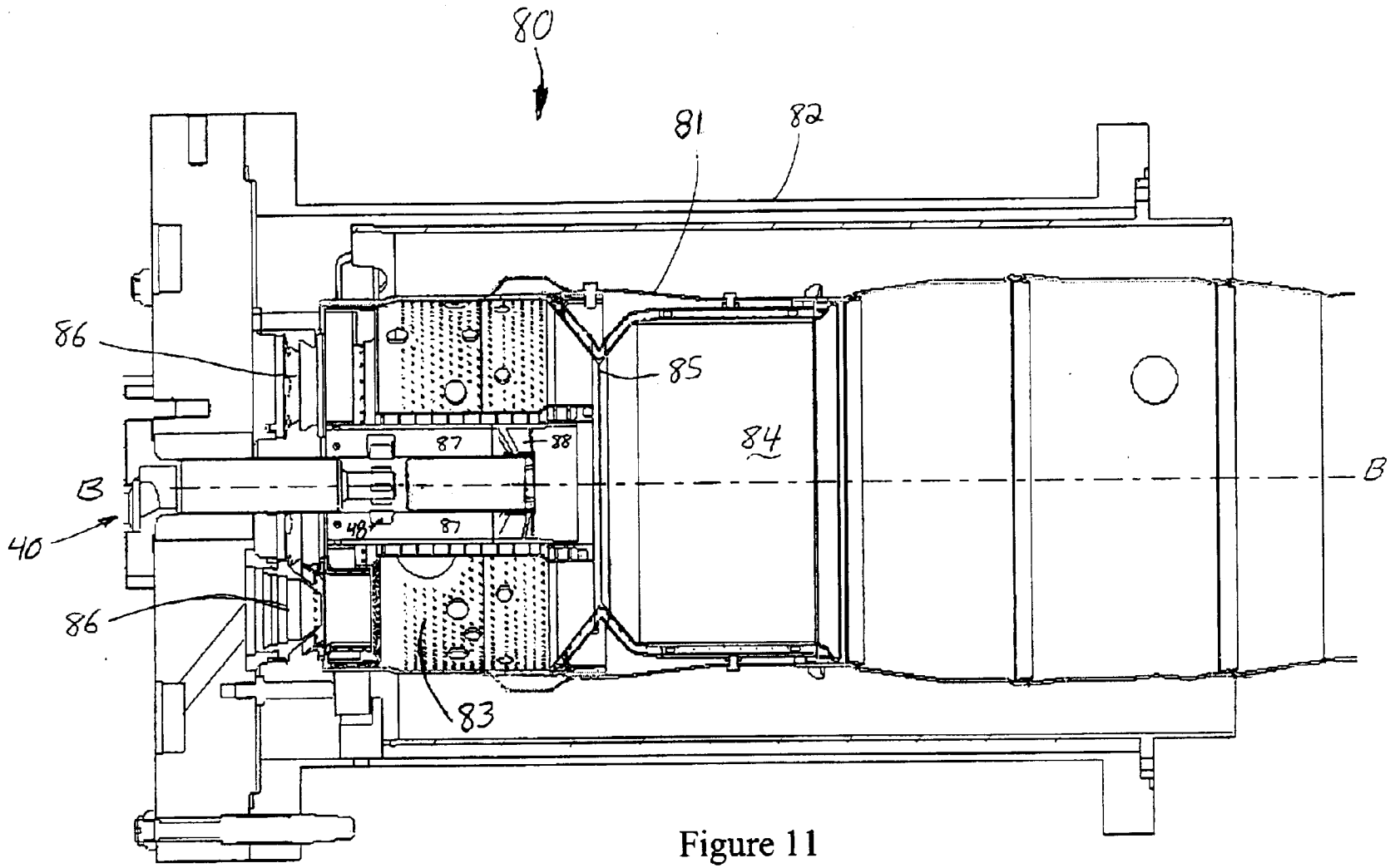
FIG. 11 is a partial cross section view of the preferred embodiment of the present invention installed in a gas turbine combustor.

The present invention is preferably used in a dual stage dual mode combustion system similar to that shown in FIG. 11. An overall reduction in combustor emissions is expected when the present invention is used in conjunction with a dual stage dual mode combustor. In this configuration, the combustion system 80 comprises a liner 81, which is contained within a pressure vessel 82, and has a primary combustion chamber 83 and a secondary combustion chamber 84 adjacent to and downstream of primary combustion chamber 81, separated by a venturi 85. At least one primary fuel nozzle 86 is positioned radially about a centerline B—B to deliver fuel to primary combustion chamber 83. Located along centerline B—B, surrounded by at least one primary fuel nozzle 86, and positioned to inject fuel towards secondary combustion chamber 84 is secondary fuel nozzle assembly 40. Either the preferred embodiment fuel nozzle assembly 40 or alternate embodiment fuel nozzle assembly 65 could be installed in this type combustion system to aid in flame stability and moving the flame from primary combustion chamber 83 to secondary combustion chamber 84. In operation, a flame is first established in primary combustion chamber 83 when all fuel is injected into the combustion system through primary fuel nozzles 86. Fuel is then gradually reduced to primary fuel nozzles 86 and gradually increased to secondary fuel nozzle assembly 40, such that fuel is injected through both locations. Fuel injected from first injector 48 of secondary fuel nozzle assembly 40 is mixed with air in surrounding passage 87 and passes through a swirler 88. This premixture then combusts in a region downstream of swirler thereby creating a flame front in secondary combustion chamber 84. In order to move the flame front from primary combustion chamber 83 to secondary combustion chamber 84, fuel flow to secondary fuel nozzle assembly 40 is increased such that all fuel for the combustor is being injected through first injector 48 and no fuel is injected through primary fuel nozzles 86. As a result, the flame in primary combustion chamber 83 is extinguished. First holes 49 in first injector 48 of secondary fuel nozzle assembly 40 are sized to allow for the necessary fuel flow rates under all operating conditions. Once flame is established only in secondary combustion chamber 84, fuel flow is gradually decreased to secondary fuel nozzle assembly 40 and increased to primary fuel nozzles 86 to create a premixture of fuel and air in primary combustion chamber 83 that, once thoroughly mixed, will combust in secondary combustion chamber 84.

Secondary fuel nozzle assembly 40 is an improvement over the prior art in multiple aspects. First, emissions will be reduced due to the elimination of the dedicated pilot circuit, since in the present invention, all fuel is injected into the surrounding air through a first injector 48 upstream of third passage 52, thereby increasing the distance and associated time for the fuel and air to mix. Increased mixing distance and time allow for fuel and air to create a more homogeneous mixture and will burn more completely reducing the amount of NOx and CO emissions. Second, overall manufacturing of the fuel nozzle assembly has been simplified by the elimination of the dedicated pilot fuel circuit, thereby reducing manufacturing time.

While the invention has been described in what is known as presently the preferred embodiment, it is to be understood that the invention is not to be limited to the disclosed embodiment but, on the contrary, is intended to cover various modifications and equivalent arrangements within the scope of the following claims.

I claim:

1. A secondary fuel nozzle assembly for use in a dual stage—dual mode gas turbine combustor, said fuel nozzle assembly comprising:

a base;

a means for supplying a fuel to said base;

a nozzle body comprising:

an elongated tube having a first and second opposing ends, having a centerline defined therethrough, said first end of said elongated tube fixed to and in fluid communication with said base, and a tip region proximate said second end;

at least one first injector extending radially away and fixed to said elongated tube, said first injector containing at least one first injector hole for injecting a fuel into a combustor such that compressed air surrounding said fuel nozzle mixes with said fuel to form a premixture;

a first passage located within said elongated tube and extending from said first end to proximate said at least one first injector, wherein said first passage is in fluid communication with said at least one first injector;

a plurality of second passages extending from upstream of said at least one first injector to downstream of said first passage, said plurality of second passages in fluid communication with said compressed air surrounding said fuel nozzle;

a third passage in fluid communication with said plurality of second passages and extending from downstream of said first passage to said tip region;

an injector plate proximate said tip region, said injector plate having an outer surface and a plurality of second injector holes that are in fluid communication with said third passage;

wherein all fuel is injected into said surrounding air upstream of said third passage.

2. The fuel nozzle assembly of claim 1 wherein said at least one first injector consists of at least one radially extending projection.

3. The fuel nozzle assembly of claim 1 wherein said at least one first injector hole is oriented generally in a downstream direction.

4. The fuel nozzle assembly of claim 3 wherein said at least one first injector hole has a first diameter of at least 0.070 inches.

5. The fuel nozzle assembly of claim 1 wherein said first injector comprises an annular manifold circumferentially disposed about said elongated tube and affixed to a plurality of support members, said support members affixed to said elongated tube, said annular manifold having a plurality of first injector holes situated about its periphery and oriented to inject said fuel in a downstream direction, at least one of said first injector holes being circumferentially offset from said support members.

6. The fuel nozzle assembly of claim 5 wherein said first injector hole has a first diameter of at least 0.055 inches.

7. The fuel nozzle assembly of claim 1 wherein said at least one second passage consists of four passages.

8. The fuel nozzle assembly of claim 1 wherein said at least one second passage and said third passage transmit air to said injector plate.

9. The fuel nozzle assembly of claim 1 wherein said second injector holes are generally perpendicular to said injector plate outer surface.

10. The fuel nozzle assembly of claim 9 wherein said second injector holes have a second diameter of at least 0.035 inches.

11. A gas turbine combustion system having reduced operating emissions, said combustion system comprising:

a primary combustion chamber;

at least one primary fuel nozzle to deliver fuel to said primary combustion chamber;

a secondary combustion chamber adjacent to and downstream of said primary combustion chamber wherein said primary and secondary combustion chambers are separated by a venturi;

a secondary fuel nozzle assembly positioned to inject fuel towards said secondary combustion chamber and surrounded by a plurality of said primary fuel nozzles wherein said secondary fuel nozzle assembly comprises:

a base;

a means for supplying a fuel to said base;

a nozzle body comprising:

an elongated tube having a first and second opposing ends, having a centerline defined therethrough, said first end of said elongated tube fixed to and in fluid communication with said base, and a tip region proximate said second end;

at least one first injector extending radially away and fixed to said elongated tube, said first injector containing at least one first injector hole for injecting a fuel into a combustor such that compressed air surrounding said fuel nozzle mixes with said fuel to form a premixture;

a first passage located within said elongated tube and extending from said first end to proximate said at least one first injector, wherein said first passage is in fluid communication with said at least one first injector;

a plurality of second passages extending from upstream of said at least one first injector to downstream of said first passage, said plurality of second passages in fluid communication with said compressed air surrounding said fuel nozzle;

a third passage in fluid communication with each of said second passages and extending from downstream of said first passage to said tip region;

an injector plate proximate said tip region, said injector plate having an outer surface and a plurality of second injector holes that are in fluid communication with said third passage;

wherein all fuel is injected into said surrounding air upstream of said third passage.

12. The fuel nozzle assembly of claim 11 wherein said at least one first injector consists of at least one radially extending projection.

13. The fuel nozzle assembly of claim 11 wherein said at least one first injector hole is oriented generally in a downstream direction.

14. The fuel nozzle assembly of claim 13 wherein said at least one first injector hole has a first diameter of at least 0.070 inches.

15. The fuel nozzle assembly of claim 11 wherein said first injector comprises an annular manifold circumferentially disposed about said elongated tube and affixed to a plurality of support members, said support members affixed to said elongated tube, said annular manifold having a plurality of first injector holes situated about its periphery and oriented to inject said fuel in a downstream direction, at least one of said first injector holes being circumferentially offset from said support members.

16. The fuel nozzle assembly of claim 15 wherein said first injector hole has a first diameter of at least 0.055 inches.

17. The fuel nozzle assembly of claim 11 wherein said at least one second passage consists of four passages.

18. The fuel nozzle assembly of claim 11 wherein said at least one second passage and said third passage transmit air to said injector plate.

19. The fuel nozzle assembly of claim 11 wherein said second injector holes are generally perpendicular to said injector plate outer surface.

20. The fuel nozzle assembly of claim 19 wherein said second injector holes have a second diameter of at least 0.035 inches.

* * * * *